US012721404B2

(12) United States Patent
Dua et al.

(10) Patent No.: US 12,721,404 B2
(45) Date of Patent: Sep. 1, 2026

(54) NONWOVEN TEXTILE FOR FOOTWEAR WITH ENTANGLED FOLDED EDGE

(71) Applicant: NIKE, Inc., Beaverton, OR (US)

(72) Inventors: Bhupesh Dua, Portland, OR (US); Pamela S. Greene, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 13 days.

(21) Appl. No.: 18/602,891

(22) Filed: Mar. 12, 2024

(65) Prior Publication Data

US 2024/0215685 A1 Jul. 4, 2024

Related U.S. Application Data

(62) Division of application No. 16/638,931, filed as application No. PCT/US2017/064012 on Nov. 30, 2017, now Pat. No. 11,944,156.

(Continued)

(51) Int. Cl.

| | |
|---|---|
| ***A43B 23/02*** | (2006.01) |
| ***D04H 1/46*** | (2012.01) |
| ***D04H 1/492*** | (2012.01) |
| ***D04H 1/70*** | (2012.01) |
| ***D04H 3/10*** | (2012.01) |
| ***D04H 3/105*** | (2012.01) |
| ***D04H 3/11*** | (2012.01) |
| ***D04H 13/00*** | (2006.01) |

(52) U.S. Cl.

CPC ..... *A43B 23/0245* (2013.01); *A43B 23/0235* (2013.01); *D04H 1/46* (2013.01); *D04H 1/492* (2013.01); *D04H 1/70* (2013.01); *D04H 3/10* (2013.01); *D04H 3/105* (2013.01); *D04H 3/11* (2013.01); *D04H 13/00* (2013.01); *D10B 2501/043* (2013.01); *Y10T 428/2419* (2015.01)

(58) Field of Classification Search

None

See application file for complete search history.

(56) References Cited

U.S. PATENT DOCUMENTS 702,390 A * 6/1902 Arnold et al.
2,020,928 A 11/1935 Asnes (Continued)

FOREIGN PATENT DOCUMENTS

CN 1121968 A 5/1996
CN 102933375 A 2/2013

(Continued)

OTHER PUBLICATIONS

Office Action received for European Application No. 23193957.0, mailed on Oct. 15, 2024, 6 pages.

*Primary Examiner* — Shawn Mckinnon

(74) *Attorney, Agent, or Firm* — Shook, Hardy & Bacon L.L.P.

(57) ABSTRACT

An article and method includes a nonwoven textile forming at least part of an upper of an article of footwear and binding fibers entangled with fibers of the folded portion and the major portion, the edge being secured, at least in part, to the major surface. The nonwoven textile is comprised of fibers and has a major portion and a folded portion, the folded portion including an edge of the nonwoven textile folded over to bring the edge in contact, at least in part, with a major surface of the major portion to form a folded edge.

20 Claims, 6 Drawing Sheets

Related U.S. Application Data

(60) Provisional application No. 62/546,423, filed on Aug. 16, 2017.

(56) References Cited

U.S. PATENT DOCUMENTS

| | | | | |
|---|---|---|---|---|
| 4,602,442 | A | 7/1986 | Revill et al. | |
| 4,927,070 | A | 5/1990 | Kretchmer | |
| 5,403,527 | A | 4/1995 | West | |
| 5,534,330 | A | 7/1996 | Groshens | |
| 8,051,583 | B2 | 11/2011 | Roether et al. | |
| 2009/0120603 | A1 | 5/2009 | Fujita et al. | |
| 2009/0303460 | A1 | 12/2009 | Habel et al. | |
| 2010/0159771 | A1 | 6/2010 | Fujisawa et al. | |
| 2010/0199406 | A1* | 8/2010 | Dua | B29D 35/00 2/243.1 |
| 2012/0021186 | A1 | 1/2012 | Schneider | |
| 2013/0260629 | A1 | 10/2013 | Dua et al. | |
| 2018/0199655 | A1 | 7/2018 | Lyttle et al. | |
| 2019/0047231 | A1 | 2/2019 | Dua et al. | |
| 2019/0366680 | A1 | 12/2019 | Dua et al. | |
| 2019/0387830 | A1 | 12/2019 | Dua et al. | |
| 2019/0387831 | A1 | 12/2019 | Dua et al. | |
| 2019/0387839 | A1 | 12/2019 | Dua et al. | |
| 2020/0008512 | A1 | 1/2020 | Dua et al. | |
| 2020/0008514 | A1 | 1/2020 | Dua et al. | |
| 2020/0060377 | A1 | 2/2020 | Dua et al. | |
| 2020/0149216 | A1 | 5/2020 | Murahara et al. | |

FOREIGN PATENT DOCUMENTS

| | | | |
|---|---|---|---|
| CN | 104334042 | A | 2/2015 |
| CN | 104754976 | A | 7/2015 |
| EP | 1978153 | A1 | 10/2008 |
| EP | 2006442 | A1 | 12/2008 |
| EP | 2006444 | A2 | 12/2008 |
| EP | 3112530 | A1 | 1/2017 |
| GB | 2132554 | A | 7/1984 |
| JP | 06-009502 | U | 2/1994 |
| JP | 07-020811 | U | 4/1995 |
| JP | 2006-055467 | A | 3/2006 |
| WO | 2004/049853 | A1 | 6/2004 |
| WO | 2015/126613 | A1 | 8/2015 |
| WO | 2016/138234 | A1 | 9/2016 |

* cited by examiner

NONWOVEN TEXTILE FOR FOOTWEAR WITH ENTANGLED FOLDED EDGE

CROSS-REFERENCE TO RELATED APPLICATION

This application is a divisional of U.S. application Ser. No. 16/638,931 (filed Feb. 13, 2020), which is a 35 U.S.C. § 371 national stage application of PCT Application No. PCT/US2017/064012 (filed Nov. 30, 2017), which claims the priority benefit of U.S. Application No. 62/546,423 (filed Aug. 16, 2017). Each of the aforementioned applications is hereby incorporated herein by reference in its entirety.

FIELD OF THE INVENTION

The subject matter disclosed herein generally relates to a nonwoven textile having a folded edge entangled into a major surface of the nonwoven textile.

BACKGROUND OF THE INVENTION

Articles of footwear and other garments and apparel are conventionally based on individual pieces of material being cut or otherwise shaped and then affixed to one another. Thus, simplistically, a shoe may be formed by cutting pieces of material, such as leather and/or fabric, into predetermined shapes from larger pieces of the material. The cut pieces are then sewn, glued, or otherwise secured with respect to one another as an upper portion, or "upper," that encloses the foot. The upper is then secured to a sole to form the major portion of a shoe.

BRIEF DESCRIPTION OF THE DRAWING

Some embodiments are illustrated by way of example and not limitation in the figures of the accompanying drawings.

DETAILED DESCRIPTION OF THE INVENTION

Example methods and systems are directed to a nonwoven textile having a folded edge entangled into a major surface of the nonwoven textile. Examples merely typify possible variations. Unless explicitly stated otherwise, components and functions are optional and may be combined or subdivided, and operations may vary in sequence or be combined or subdivided. In the following description, for purposes of explanation, numerous specific details are set forth to provide a thorough understanding of example embodiments. It will be evident to one skilled in the art, however, that the present subject matter may be practiced without these specific details.

In the conventional method of making an article of footwear described above, the formation of the upper thus involves the wastage of scrap from the larger pieces to make the cut pieces as well as the labor and effort to individually affix the cut pieces to one another. Weaving techniques may reduce the amount of waste in forming the upper by weaving the upper from one or a limited number of pieces. However, such woven uppers may limit the scope of design of the upper, both cosmetically (e.g., limitations on the woven pattern instead of allowing for flat finishes or emulation of other materials, such as faux leather) and mechanically (e.g., waterproofing), owing to physical properties of the weave.

Moreover, while techniques involving nonwoven textiles may allow for the creation of unconventional designs than may not readily be found in woven uppers, nonwoven textiles may have edges which conventionally may be subject to fraying or other deterioration if the edges are not modified in some way. However, doing so may be unsightly (e.g., in cases where the edge is melted) or may involve additional manufacturing steps (e.g., where the edge is stitched) which add to complexity and cost.

A nonwoven textile and related upper for an article of footwear has been developed using deposited fibers. The deposited fibers are formed into a sheet having a major surface. At one of the edges of the sheet, the sheet is folded over onto itself, creating a folded region and bringing the edge into contact with the major surface. Fibers of one or both of the folded regions and non-folded regions are then entangled with respect to the fibers of the other region, e.g., the fibers of the folded region are entangled with the fibers of the non-folded region. In other words, the fibers of the nonwoven textile are entangled with respect to themselves to secure the fold along the edge, providing, in various cases, for relatively increased strength along the edge in comparison with other techniques and a smooth, substantially uniform edge.

Figure 1:
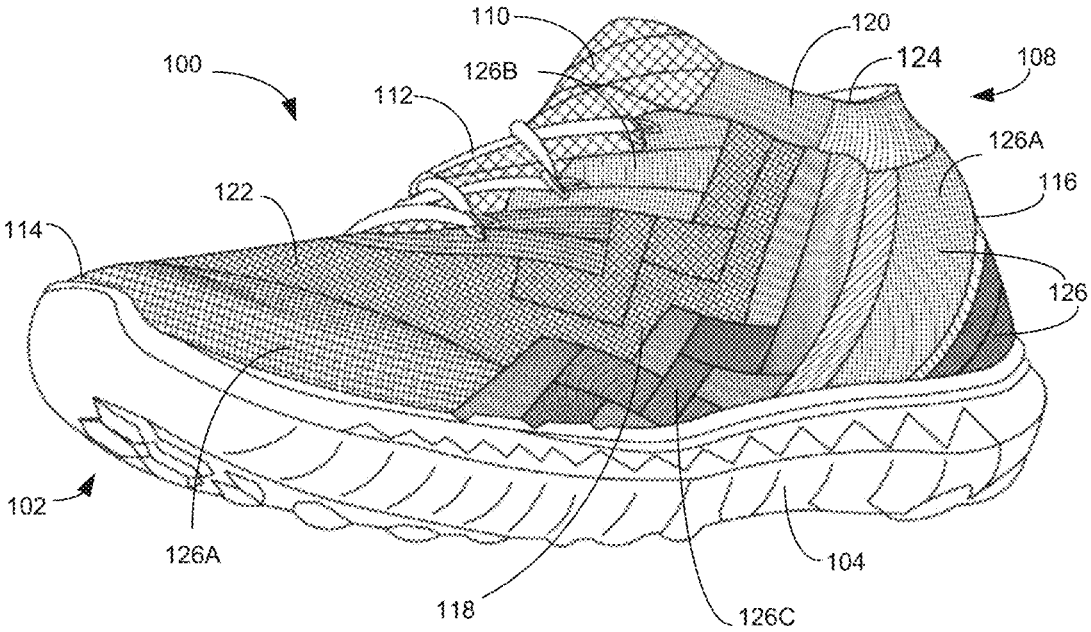
FIG. 1 is a depiction of an article of footwear, in accordance with an exemplary aspect hereof.

FIG. 1 is a depiction of an article of footwear 100, in an example embodiment. While the article of footwear 100 is illustrated herein, it is to be recognized and understood that the principles disclosed herein are applicable as well to articles of apparel generally, including garments worn on various parts of the body such as support garments, backpacks, gloves, and the like. Furthermore, the principles disclosed herein may be applied to the generation of materials and combinations of materials that may be applied to any suitable circumstances, whether or not related to being worn on a human body (e.g., to containers, such as saddle bags for bicycles). As such, the principles disclosed herein are applicable without respect to the use of the resultant materials and combinations of materials.

The article of footwear 100 includes a sole section 102 including an outsole 104 designed to come into contact with a surface, such as the ground or a floor, and an insole (obscured) configured to seat and generally conform to the sole of a human foot. The article of footwear further includes an upper section 108 or "upper" configured to enclose the human foot. The upper 108 is formed, at least in part, from fibers as disclosed herein. In an example, the upper 108 is formed from a single manufactured piece, as disclosed herein. A tongue 110 is configured to facilitate securing the article of footwear 100 to the human foot via laces 112. The article of footwear 100 conventionally includes a toe region 114, a heel region 116, a midsection region 118, and a collar 120.

As illustrated, and as will be disclosed in detail herein, the upper 108 includes or is based on a nonwoven textile 122. The nonwoven textile 122 may be formed as a sheet prior to processing into the upper 108. In the illustrated example, the nonwoven textile 122 includes a folded edge 124 at the collar 120, as disclosed in detail herein. While the folded edge 124 is described as being at the collar 120, however, it is to be recognized and understood that the principles described with respect to the collar 120 may be applied to any edge of the nonwoven textile 122 and various alternative examples of the nonwoven textile 122 may include a folded edge 124 in other locations and not at the collar 120. The illustrated example of the nonwoven textile 122 further includes various zones 126 of varying characteristics of deposited fibers. The zones 126 exhibit differing properties, including properties such as color, texture, thickness, stiffness, resiliency, elasticity and the like. Certain zones 126A have common properties and are made according to the same processes while other zones 126B, 126C include at least some differences in properties with respect to one another owing to different materials and manufacturing processes used therein.

Figure 2:
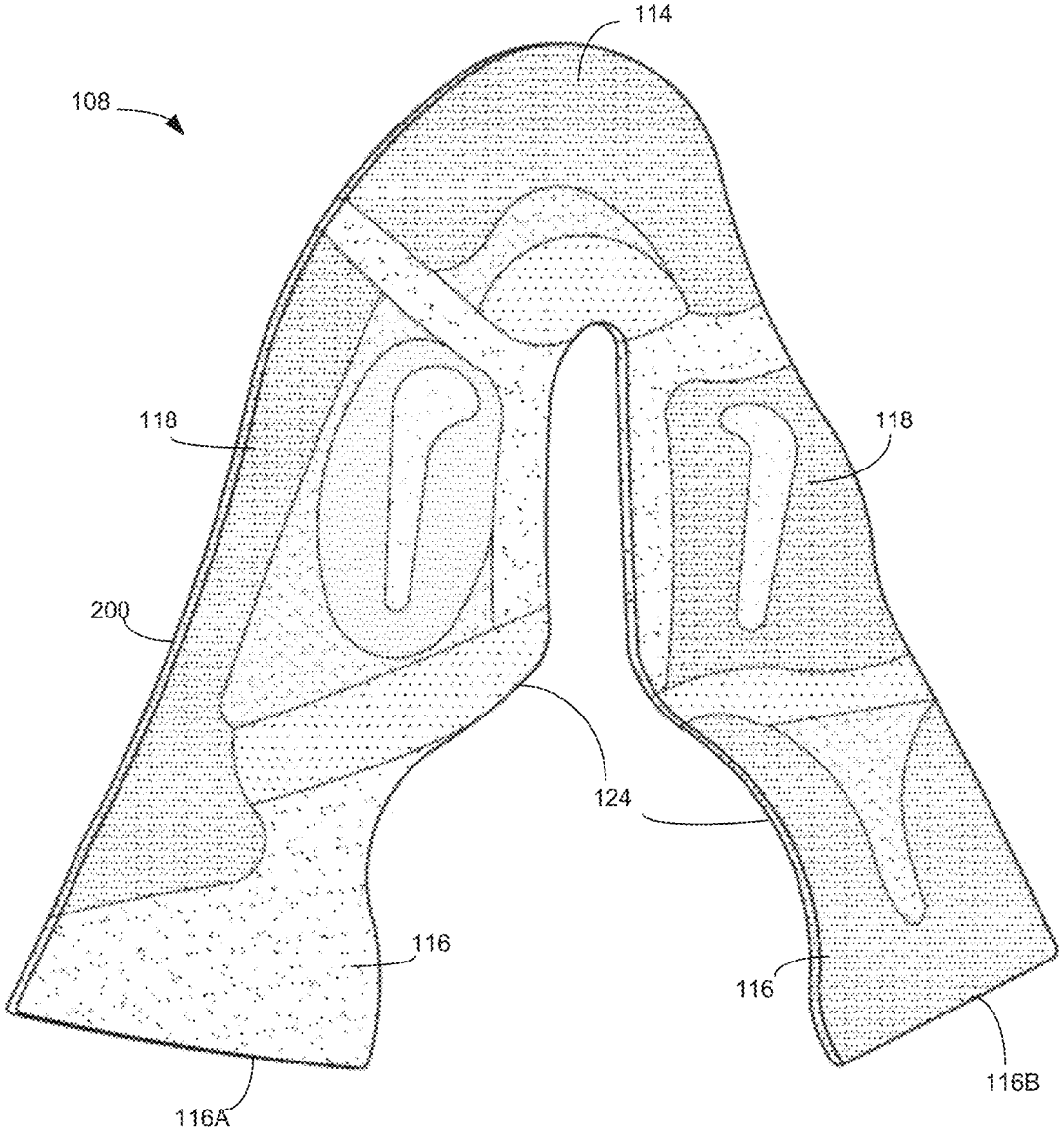
FIG. 2 is an image of an upper having a folded edge, in accordance with an exemplary aspect hereof.

FIG. 2 is an image of an upper 108 having a folded edge 124, in an example embodiment. As illustrated, the upper 108 is not yet included in an article of footwear 100 but rather may be in the illustrated form during a manufacturing process of the article of footwear 100. The upper 108 includes the toe region 114 and midsection region 118 of the article of footwear 100. The heel region 116 of the article of footwear 100 is formed by coupling two seam edges 116A, 116B together, such as by sewing, gluing, fastening, or otherwise affixing or securing the seam edges 116A, 116B to one another. One or both of the seam edges 116A, 116B have a folded edge, as disclosed herein. It is noted and emphasized that alternative examples may place a seam not in the heel region 116 but, for instance, in the midsection region 118, among other potential locations. The article of footwear 100 may further be formed by securing a bottom edge 200 of the upper 108 to the sole section 102 by glue, stitching, fasteners, or any other suitable mechanism known in the art.

The upper 108 is depicted as a substantially flat sheet during an initial manufacture stage. In various examples, the fibers are deposited or otherwise formed into the shape of the upper 108 on a substantially flat surface, resulting in the upper 108 being initially formed in a substantially flat configuration, with variations in thickness of the upper between zones 126 not detracting from the overall flatness of the upper 108 at that stage of manufacture. Three-dimensional shape is, in such examples, added as a result of forming the folded edge 124 and joining the heel edges 116A, 116B together, among other potential manufacturing steps.

Figure 3:
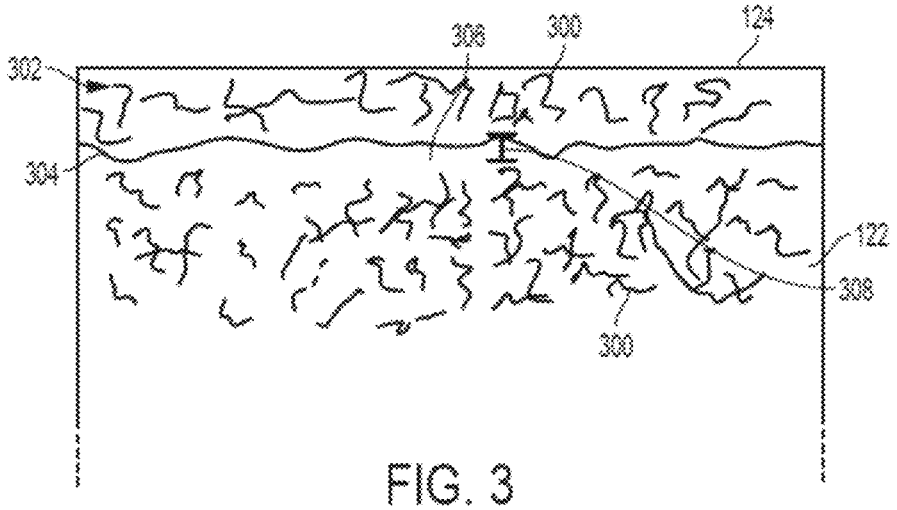
FIG. 3 is a detailed side-view of a folded edge of a nonwoven textile, in accordance with an exemplary aspect hereof.

FIG. 3 is a detailed surface-view of the folded edge 124 of the nonwoven textile 122, in an example embodiment. Fibers 300 (exaggerated in size and reduced in density for the purposes of the clarity of this illustration) are deposited and entangled with respect to one another to form the nonwoven textile 122. In manufacture, the fibers 300 may be deposited as a sheet on a surface which is not incorporated into the upper 108, or may be deposited on a textile backing material which may be incorporated into the upper 108. The backing material may be any of a variety of suitable materials, including a woven textile formed from a yarn or other suitable material.

The nonwoven textile 122 includes a folded region 302. The folded region 302 is defined essentially by a portion of the nonwoven textile 122 where the manufactured sheet is folded over on itself. A rough edge 304 of the sheet is folded into contact with a major surface 306 of the sheet. Certain fibers 300 of the folded region 302 are then entangled with respect to one another, securing the rough edge 304 of the sheet to the major surface 306 and creating the folded edge 124.

The folded edge 124 may be substantially uniform, in contrast to the rough edge 302. As described above, owing to the manufacture process in which fibers 300 are deposited to form the nonwoven textile 122, the rough edge 302 may have a non-uniform or irregular horizontal variance 308. In various examples, the folded edge 124 is substantially uniform by having less of a horizontal variance 308 than the rough edge 302. Additionally or alternatively, the folded edge 124 has a horizontal variance 308 of less than approximately twenty (20) percent.

Figure 4:
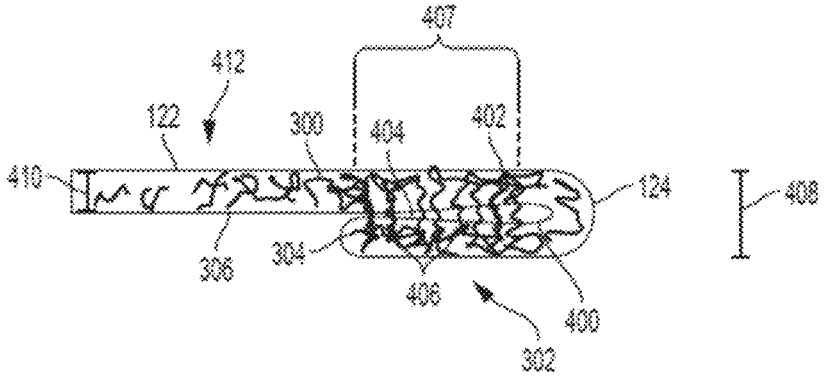
FIG. 4 is a detailed side-view of a folded edge of a nonwoven textile, in accordance with an exemplary aspect hereof.

FIG. 4 is a detailed side-view of the folded edge 124 of the nonwoven textile 122, in an example embodiment. The rough edge 304 has been folded over about the resultant folded edge 124 to come into contact with the major surface 306 of the nonwoven textile 122. For the purposes of this illustration, the otherwise unitary nonwoven textile 122 may be understood to include a folded portion 400 and a major portion 402, demarcated by the folded edge 124.

The rough edge 304 and a secondary surface 404 of the folded portion 400 are secured to the major surface 306 of the major portion 402 with binding fibers 406. In various examples, the binding fibers 406 are or were integral fibers 300 of the folded portion 400 which have been entangled into the fibers 300 of the major portion 402. Alternatively, the binding fibers 406 are or were integral fibers 300 of the major portion 402 which have been entangled into the fibers 300 of the folded portion 400. Stated differently, the binding fibers 406 start as fibers 300 formed in a sheet and then, after the folded portion 400 is folded over in a manufacturing process, an entangling mechanism forces one end of the binding fiber 406 out of the portion, e.g, the folded portion 400, in which the binding fiber 406 started and into and entangled with the fibers 300 of the other portion, e.g., the major portion 402. It is noted that examples in which fibers 300 of both portions 400, 402 become binding fibers 406 are contemplated, e.g., fibers 300 from the folded portion 400 are entangled in the major portion 402 and fibers 300 from the major portion 402 are entangled in the folded portion 400, either concurrently or in separate steps of a manufacturing process.

In such examples, the binding fibers 406 are a portion of the fibers 300 of the nonwoven textile 122. Consequently, the binding fibers 406 may consist essentially of fibers 300 which have been entangled from one portion 400, 402 into the other portion 400, 402. Moreover, the binding fibers 406 may be understood to be contained within a binding region 407, located inward within the nonwoven textile 122 relative to the folded edge 124. The binding fibers 406 may be entangled with the fibers 300 within the binding region 407 according to any desired layout or pattern, including a random pattern, a semi-random pattern, or a regular pattern.

Additionally or alternatively, some or all of the binding fibers 406 may be fibers which were not previously incorporated into the nonwoven textile 122 prior to being utilized to bind the folded portion 400 to the major portion 402. In such an example, an entangling mechanism may pass the binding fibers 406 first into and through one portion, e.g., the folded portion 400, and then into the other portion, e.g., the major portion 402. Thus, in various examples, the upper 108 need not necessarily be formed from a wholly nonwoven textile provided that nonwoven binding fibers 406 can be entangled with the material of the upper 108 to secure the folded portion 400 to the major portion 402. As such, a first portion of the binding fibers 406 may be or may originally have been fibers 300, while a second portion of the binding fibers 406 may be fibers which were not previously incorporated into the nonwoven textile 122.

The resultant nonwoven textile 122 may have varying thicknesses, including a first thickness 408 in the folded region 302 and a second thickness 410 in a non-folded region 412. In the illustrated example, folded portion 400 and the major portion 402 each have the second thickness 410 because the underlying sheet of the nonwoven textile 122 has a constant thickness. As a result, in the illustrated example, the first thickness 408 is approximately twice the second thickness 410.

However, it is to be recognized and understood that the sheet of the nonwoven textile 122 may have various thicknesses and other properties, as disclosed herein. Thus, in an example, the fibers 300 of the folded region 302 have a density and loft greater than the fibers 300 of the non-folded region 412. In such an example, the first thickness 408 may be more than twice as great as the second thickness 410 while also potentially providing a softer and less resilient feel for the nonwoven textile 122 in the folded region 302 than in the non-folded region 412. Relatedly, the thickness of the sheet may be greater in the non-folded region 412 than in the folded region 302, resulting in the first thickness 408 being less than twice the second thickness 410, and in an example, the first thickness 408 is approximately as thick as the second thickness 410.

As such, it is to be understood that the fibers 300 and the deposition of the fibers 300 with respect to one another do not necessarily have uniform properties and that, as a result, the nonwoven textile 122 may vary in thickness, loft, softness, resilience, elasticity, pliability, and the like in various locations as desired. Thus, in various examples, the nonwoven textile 122 may be relatively thin and pliable in the midsection region 118, of medium thickness with high resilience and low pliability in the toe region 114 and heel region 118, and of high thickness and softness in the collar region 120 proximate the folded edge 124.

The fibers 300 and/or binding fibers 406 may be any suitable fibers including natural fibers (e.g., cotton, jute, bamboo, ramie, hemp, flax, and combinations thereof); synthetic, polymeric fibers such as thermoplastic fusible fibers including polyolefin fibers; or combinations of natural and synthetic, polymeric fibers. In some examples, the polyolefin fibers can have a melting temperature in the range of about 150° ° C. to about 250° ° C. (e.g., from about 160° C. to about 200° ° C., about 160° ° C. to about 180° ° C. or about 160° C. to about 170° C.). The term "polyolefin fibers" generally refers to fibers (e.g., manufactured fibers) in which the fiber-forming substance is any long chain synthetic polymer comprised of at least 85 percent by weight of ethylene, propylene, or combinations of ethylene and propylene units or other suitable olefin units. In some examples, the polyolefin fibers do not comprise any substantial amount of amorphous (non-crystalline) polyolefins qualifying as rubber. Another example of thermoplastic fusible fibers is polyester fiber (e.g., a low-melt polyester fiber).

Figure 5A:
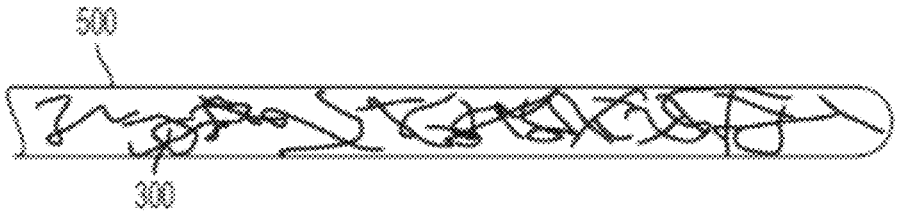
FIGS. 5A-5C illustrate a process by which a folded edge of a nonwoven textile may be manufactured, in accordance with an exemplary aspect hereof.
Figure 5B:
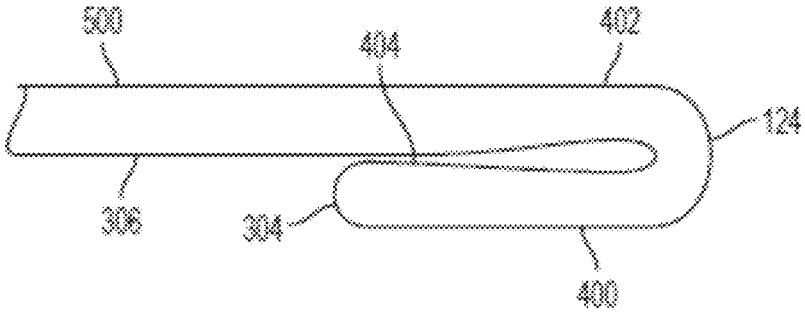
Figure 5C:
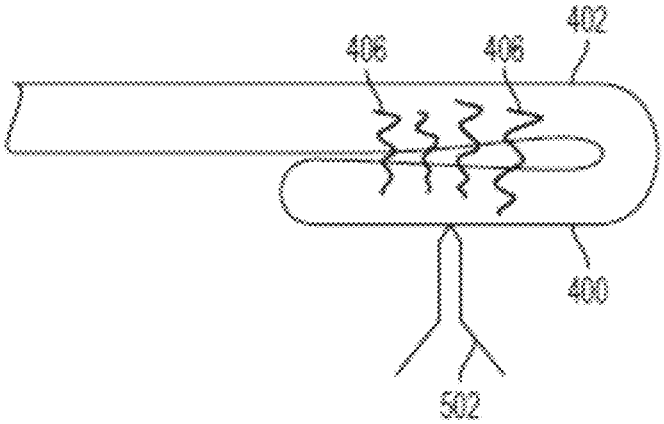

FIGS. 5A-5C illustrate a process by which the folded edge 124 of the nonwoven textile 122 may be manufactured, in an example embodiment. FIG. 5A illustrates a sheet 500 made from fibers 300. At FIG. 5B, the sheet 500 is folded about the resultant folded edge 124 until the rough edge 304 and secondary surface 404 are in contact with the major surface 306, creating the folded portion 400 and the major portion 402. (Fibers 300 are not depicted for clarity.) At FIG. 5C, an entangling mechanism 502 causes binding fibers 406 of the fibers 300 of the folded portion 400 to entangle with the fibers 300 of the major portion 402, securing the folded portion 400 with respect to the major portion 402. (Fibers 300 are again not depicted for clarity.) In various examples, the entangling mechanism 502 is one, some, or all of a waterjet and/or hydroentanglement mechanism, a needlepunch entanglement mechanism, and/or an airlaying entanglement mechanism as known in the art, or any other suitable entanglement mechanism which is known or which has yet to be developed. The result is the folded edge 124 of the nonwoven textile 122 as disclosed herein.

The process illustrated in FIGS. 5A-5C is not exhaustive of the processes by which the folded edge 124 of the nonwoven textile 122 may be formed or manufactured. As disclosed herein, the entangling mechanism 502 may be applied to one or both of the portions 400, 402 in order to entangle the binding fibers 406 between the portions 400, 402. Moreover, the process does not necessarily preclude the use of adhesives or other securing mechanisms in addition to the binding fibers 406, though it is emphasized that the use of binding fibers 406 may produce a sufficiently strong bond between the portions 400, 402 that additional securing mechanisms may be unnecessary.

FIGS. 6A-6E are depictions of nonwoven textiles having folded edges 124, in example embodiments. In general, the nonwoven textiles depicted in FIGS. 6A-6E have greater cushioning than the nonwoven textile 122. The various nonwoven textiles may be utilized in place of the nonwoven textile 122 in making an upper, such as the upper 108, in the manufacture of the article of footwear 100. It is to be recognized and understood that the principles disclosed herein may be expanded to any of a variety of cushioning mechanisms as desired.

Figure 6A:
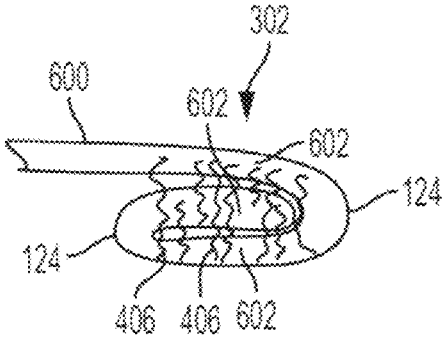
FIGS. 6A-6E are depictions of nonwoven textiles having folded edges, in accordance with an exemplary aspect hereof.

FIG. 6A is a depiction of a nonwoven textile 600 having multiple folded edges 124 and multiple layers 602. The folded region 302 is created as disclosed herein and then a second fold creates a second folded edge 124. It is to be recognized that three layers 602 are depicted but that as many layers 602 as desired may be formed. Binding fibers 406 may entangle with the fibers 300 of each layer 602 to secure the layers 602 with respect to one another. Individual binding fibers 406 may extend through all three layers 602 in the illustrated example or through only two of the layers 602 provided that each layer 602 has binding fibers 402 that connect that layer 602 to another layer 602, as illustrated.

Figure 6B:
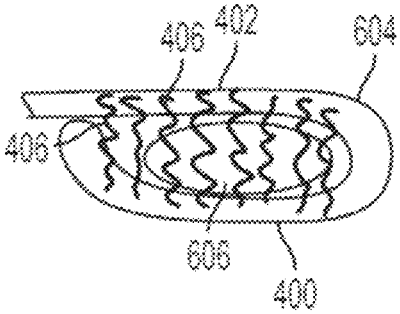
Figure 6C:
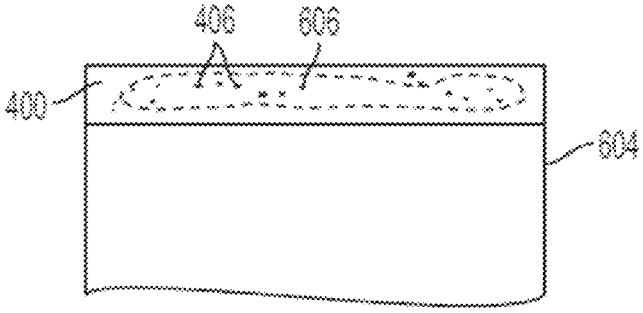

FIGS. 6B and 6C are side and surface depictions, respectively, of a nonwoven textile 604 having a cushioning 606 secured between the folded portion 400 and the major portion 402. In various examples, the cushioning 606 is a nonwoven cushioning, such as a batting or other material. In such examples, the binding fibers 406 are passed through and entangled with the fibers of the cushioning 606, directly securing the cushioning 606 to the folded and major portions 400, 402. While the cushioning 606 is depicted as a single piece, it is to be recognized and understood that the cushioning 606 may be multiple individual pieces.

Figure 6D:
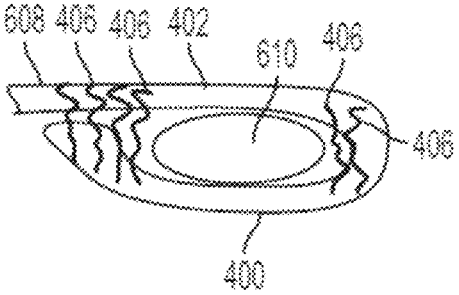
Figure 6E:
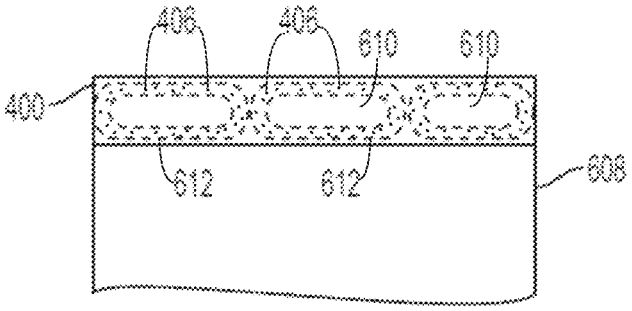

FIGS. 6D and 6E are side and surface depictions, respectively, of a nonwoven textile 608 having a cushioning 610 secured between the folded portion 400 and the major portion 402. In various examples, the cushioning 610 is a cord, foam, or other material through which the binding fibers 406 may not advantageously pass through use of needlepunching. In such an example, binding fibers 406 are utilized in zones 612 where the binding fibers 406 may entangle with the folded and major portions 400, 402 without passing through the cushioning. While the cushioning 610 is depicted as being multiple pieces, it is to be recognized that the cushioning 610 may be a single piece.

Figure 7:
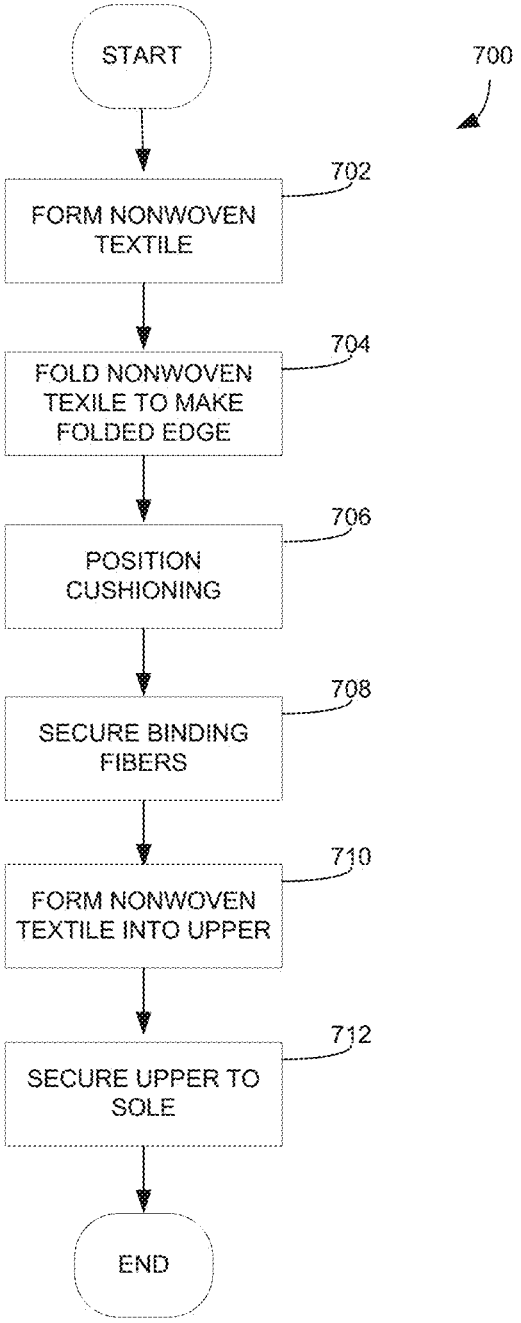
FIG. 7 is a flowchart for making an article, in accordance with an exemplary aspect hereof.

FIG. 7 is a flowchart 700 for making an article, in an example embodiment. The article may be the article of footwear 100, the upper 108, the nonwoven textile, or any suitable article. Various operations of the flowchart 700 may optionally be performed or not performed as desired.

At 702, a nonwoven textile of an upper of an article of footwear is formed by securing fibers with respect to one another. In an example, forming the nonwoven textile includes depositing the fibers to cause the folded region to have a greater loft than the unfolded region. In an example, depositing the fibers includes forming seam edges of the nonwoven textile configured to be secured with respect to one another to form, at least in part, the upper. In an example, binding fibers are entangled in at least one of the seam edges to make the at least one of the seam edges a folded seam edge. In an example, depositing the fibers includes forming a heel region of the upper, and wherein the seam edges are in the heel region At 704, a nonwoven textile of an upper of an article of footwear is folded to create a folded portion and a major portion of the nonwoven textile, the folded portion including an edge of the nonwoven textile in contact, at least in part, with a major surface of the major portion to form a folded edge. In an example, the edge is a rough edge and the folded edge is relatively more uniform than the rough edge.

At 706, a cushioning is positioned between the folded portion and the major portion. In an example, the cushioning is a nonwoven cushioning.

At 708, binding fibers of the nonwoven textile are secured with fibers of the folded portion and the major portion, the edge being secured, at least in part, to the major surface. In an example, entangling the binding fibers comprises entangling fibers from the folded portion into fibers of the major portion, the fibers entangled from the folded portion being the binding fibers. In an example, entangling the binding fibers comprises entangling fibers from the major portion into fibers of the folded portion, the fibers entangled from the major portion being the binding fibers. In an example, entangling the binding fibers comprises entangling fibers from both of the folded portion and the major portion into of the opposite portion, the fibers entangled from the folded portion and major portion being the binding fibers. In an example, entangling the binding fibers is by at least one of waterjet entanglement and needlepunch entanglement. In an example, the cushioning is secured between the folded portion and the major portion. In an example, the binding fibers pass through the cushioning.

At 710, the nonwoven textile is formed into the upper, the upper forming at least part of an enclosure for receiving a foot, wherein the folded portion of the nonwoven textile forms, at least in part, a collar region of the upper for admitting the foot into the upper. In an example, entangling the binding fibers causes the nonwoven textile to include a folded region proximate the folded edge and a non-folded region distal to the folded edge relative to the folded region, fibers of the folded region being configured so that the folded region has a thickness greater than a thickness of the non-folded region.

At 712, the upper is secured to a sole along the bottom edge of the nonwoven textile.

From the foregoing, it will be seen that aspects of this invention are well adapted to attain all the ends and objects hereinabove set forth together with other advantages which are obvious and which are inherent to the structure.

It will be understood that certain features and sub-combinations are of utility and may be employed without reference to other features and sub-combinations. This is contemplated by and is within the scope of the claims.

While specific elements and steps are described in connection to one another, it is understood that any element and/or steps provided herein are contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

Claims are provided hereinafter. Although the fiber-bound engineered materials formed utilizing engineered scrims and methods of manufacturing such materials are described above by referring to particular aspects, it should be understood that modifications and variations could be made without departing from the intended scope of protection provided by the following claims. It is contemplated that any one of the dependent claims may multiply depend from other claims of the same independent claim set. Therefore, while not specifically listed as "[t]he component of claims X-Y, wherein . . . " or "[t]he component of claims X-Y further comprising . . . ," the Applicant contemplates each dependent claim may be multiply dependent in some aspects.

As used herein and in connection with the features listed hereinafter, the terminology "any of features" or similar variations of said terminology is intended to be interpreted such that features may be combined in any combination. For example, an exemplary feature 4 may indicate the method/apparatus of any of features 1 through 3, which is intended to be interpreted such that elements of feature 1 and feature 4 may be combined, elements of feature 2 and feature 4 may be combined, elements of feature 3 and 4 may be combined, elements of features 1, 2, and 4 may be combined, elements of features 2, 3, and 4 may be combined, elements of features 1, 2, 3, and 4 may be combined, and/or other variations. Further, the terminology "any of features" or similar variations of said terminology is intended to include "any one of features" or other variations of such terminology, as indicated by some of the examples provided above.

Exemplary Features Having Multiple Dependency

Feature 1. An article, comprising: a nonwoven textile forming at least part of an upper of an article of footwear, the nonwoven textile comprised of fibers and having a major portion and a folded portion, the folded portion including an edge of the nonwoven textile folded over to bring the edge in contact, at least in part, with a major surface of the major portion to form a folded edge; and binding fibers entangled with fibers of the folded portion and the major portion, the edge being secured, at least in part, to the major surface.

Feature 2. The article of feature 1, wherein the edge is a rough edge and the folded edge is relatively more uniform than the rough edge.

Feature 3. The article of any one of features 1 and 2, wherein the upper forms at least part of an enclosure for receiving a foot and the folded portion of the nonwoven textile forms, at least in part, a collar region of the upper for admitting the foot into the upper.

Feature 4. The article of any one of features 1 through 3, wherein the nonwoven textile includes a folded region proximate the folded edge and a non-folded region distal to the folded edge relative to the folded region, fibers of the folded region being configured so that the folded region has a thickness greater than a thickness of the non-folded region.

Feature 5. The article of any one of features 1 through 4, wherein the fibers of the folded region have a greater loft than the unfolded region.

Feature 6. The article of any one of features 1 through 5, wherein the nonwoven textile further includes seam edges configured to be secured with respect to one another to form, at least in part, the upper.

Feature 7. The article of feature 6, wherein at least one of the seam edges is a folded seam edge.

Feature 8. The article of any one of features 6 and 7, wherein the nonwoven textile forms a heel region of the upper and wherein the seam edges are in the heel region.

Feature 9. The article of any one of features 1 through 8, wherein the upper includes a bottom edge, and wherein the article further comprises a sole, wherein the upper is secured to the sole along the bottom edge of the nonwoven textile.

Feature 10. The article of any one of features 1 through 9, further comprising a cushioning secured between the major portion and the folded portion.

Feature 11. The article of feature 10, wherein the cushioning is a nonwoven cushioning, and wherein at least some of the binding fibers pass through the nonwoven cushioning.

Feature 12. The article of any one of features 1 through 11, wherein the binding fibers are comprised of a portion of the fibers comprising the nonwoven textile.

Feature 13. The article of any one of features 1 through 12, wherein the binding fibers are contained within a binding region spaced inward from the folded edge, wherein the binding fibers are entangled with the fibers in a random pattern within the binding region.

Feature 14. A method, comprising: folding a nonwoven textile of an upper of an article of footwear to create a folded portion and a major portion of the nonwoven textile, the folded portion including an edge of the nonwoven textile in contact, at least in part, with a major surface of the major portion to form a folded edge; and entangling binding fibers of with fibers of the folded portion and the major portion, the edge being secured, at least in part, to the major surface.

Feature 15. The method of feature 14, wherein entangling the binding fibers comprises entangling fibers from the folded portion into fibers of the major portion, the fibers entangled from the folded portion being the binding fibers.

Feature 16. The method of feature 14, wherein entangling the binding fibers comprises entangling fibers from the major portion into fibers of the folded portion, the fibers entangled from the major portion being the binding fibers.

Feature 17. The method of feature 14, wherein entangling the binding fibers comprises entangling fibers from both of the folded portion and the major portion into of the opposite portion, the fibers entangled from the folded portion and major portion being the binding fibers.

Feature 18. The method of any one of features 14 through 17, wherein entangling the binding fibers is by at least one of hydrojet entanglement and needlepunch entanglement.

Feature 19. The method of any one of features 14 through 18, wherein the edge is a rough edge and the folded edge is relatively more uniform than the rough edge.

Feature 20. The method of any one of features 14 through 19, further comprising: forming the nonwoven textile into the upper, the upper forming at least part of an enclosure for receiving a foot, wherein the folded portion of the nonwoven textile forms, at least in part, a collar region of the upper for admitting the foot into the upper.

Feature 21. The method of any one of features 14 through 20, wherein entangling the binding fibers causes the nonwoven textile to include a folded region proximate the folded edge and a non-folded region distal to the folded edge relative to the folded region, fibers of the folded region being configured so that the folded region has a thickness greater than a thickness of the non-folded region.

Feature 22. The method of any one of features 14 through 21, further comprising forming the nonwoven textile by securing the fibers with respect to one another.

Feature 23. The method of any one of features 14 through 22, wherein forming the nonwoven textile comprises depositing the fibers to cause the folded region to have a greater loft than the unfolded region.

Feature 24. The method of any one of features 14 through 23, wherein depositing the fibers includes forming seam edges of the nonwoven textile configured to be secured with respect to one another to form, at least in part, the upper.

Feature 25. The method of feature 24, further comprising entangling binding fibers in at least one of the seam edges to make the at least one of the seam edges a folded seam edge.

Feature 26. The method of any one of features 23 and 24, wherein depositing the fibers includes forming a heel region of the upper, and wherein the seam edges are in the heel region.

Feature 27. The method of any one of features 14 through 26, wherein the nonwoven textile includes a bottom edge, and further comprising: securing the upper to a sole along the bottom edge of the nonwoven textile.

Feature 28. The method of any one of features 14 through 27, further comprising securing a cushioning between the major portion and the folded portion.

Feature 29. The method of feature 28, wherein the cushioning is a nonwoven cushioning, and wherein securing the cushioning comprises passing at least some of the binding fibers through the nonwoven cushioning.

Feature 30. The method of any one of features 14 through 29, wherein entangling the binding fibers is within a binding region spaced inward from the folded edge.

Feature 31. The method of feature 30, wherein entangling the binding fibers comprises entangling the binding fibers with the fibers in a random pattern within the binding region.

Feature 32. An article, from by operations comprising: folding a nonwoven textile of an upper of an article of footwear to create a folded portion and a major portion of the nonwoven textile, the folded portion including an edge of the nonwoven textile in contact, at least in part, with a major surface of the major portion to form a folded edge; and entangling binding fibers of with fibers of the folded portion and the major portion, the edge being secured, at least in part, to the major surface.

Feature 33. The article of feature 32, wherein entangling the binding fibers comprises entangling fibers from the folded portion into fibers of the major portion, the fibers entangled from the folded portion being the binding fibers.

Feature 34. The article of feature 32, wherein entangling the binding fibers comprises entangling fibers from the major portion into fibers of the folded portion, the fibers entangled from the major portion being the binding fibers.

Feature 35. The article of feature 32, wherein entangling the binding fibers comprises entangling fibers from both of the folded portion and the major portion into of the opposite portion, the fibers entangled from the folded portion and major portion being the binding fibers.

Feature 36. The article of any one of features 32 through 35, wherein entangling the binding fibers is by at least one of hydrojet entanglement and needlepunch entanglement.

Feature 37. The article of any one of features 32 through 36, wherein the edge is a rough edge and the folded edge is relatively more uniform than the rough edge.

Feature 38. The article of any one of features 32 through 37, further comprising: forming the nonwoven textile into the upper, the upper forming at least part of an enclosure for receiving a foot, wherein the folded portion of the nonwoven textile forms, at least in part, a collar region of the upper for admitting the foot into the upper.

Feature 39. The article of any one of features 32 through 38, wherein entangling the binding fibers causes the nonwoven textile to include a folded region proximate the folded edge and a non-folded region distal to the folded edge relative to the folded region, fibers of the folded region being configured so that the folded region has a thickness greater than a thickness of the non-folded region.

Feature 40. The article of any one of features 32 through 39, further comprising forming the nonwoven textile by securing the fibers with respect to one another.

Feature 41. The article of any one of features 32 through 40, wherein forming the nonwoven textile comprises depositing the fibers to cause the folded region to have a greater loft than the unfolded region.

Feature 42. The article of any one of features 32 through 41, wherein depositing the fibers includes forming seam edges of the nonwoven textile configured to be secured with respect to one another to form, at least in part, the upper.

Feature 43. The article of features 42, further comprising entangling binding fibers in at least one of the seam edges to make the at least one of the seam edges a folded seam edge.

Feature 44. The article of any one of features 41 and 42, wherein depositing the fibers includes forming a heel region of the upper, and wherein the seam edges are in the heel region.

Feature 45. The article of any one of features 32 through 44, wherein the nonwoven textile includes a bottom edge, and further comprising: securing the upper to a sole along the bottom edge of the nonwoven textile.

Feature 46. The article of any one of features 32 through 45, further comprising securing a cushioning between the major portion and the folded portion.

Feature 47. The article of feature 46, wherein the cushioning is a nonwoven cushioning, and wherein securing the cushioning comprises passing at least some of the binding fibers through the nonwoven cushioning.

Feature 48. The article of any one of features 32 through 47, wherein entangling the binding fibers is within a binding region spaced inward from the folded edge.

Feature 49. The article of feature 48, wherein entangling the binding fibers comprises entangling the binding fibers with the fibers in a random pattern within the binding region.

What is claimed is:

1. An article of footwear comprising:

an upper comprising an ankle collar;

the ankle collar comprising:

a nonwoven textile comprising:

a major portion, a folded portion, and an intermediate portion positioned between the major portion and the folded portion, wherein the major portion, the folded portion, and the intermediate portion are a continuous panel of the nonwoven textile, wherein a first folded edge joins the major portion to the folded portion and comprises an edge of the ankle collar of the article of footwear, wherein a second folded edge joins the folded portion to the intermediate portion and positions the intermediate portion between the major portion and the folded portion, wherein the nonwoven textile comprises first fibers in the major portion, the folded portion, and the intermediate portion; and binding fibers mechanically entangled with the first fibers of the major portion and the folded portion, wherein at least a portion of the binding fibers extend from the major portion, through the intermediate portion, and to the folded portion without extending through the first folded edge and the second folded edge.

2. The article of footwear of claim 1, wherein the nonwoven textile comprises a terminal edge that is a rough edge positioned between the major portion and the folded portion, and wherein the first folded edge and the second folded edge are more uniform than the terminal edge of the nonwoven textile.

3. The article of footwear of claim 1, wherein the intermediate portion comprises a cushioning layer between the folded portion and the major portion.

4. The article of footwear of claim 1, wherein cushioning is positioned between the intermediate portion and the folded portion.

5. The article of footwear of claim 4, wherein the binding fibers extend from the major portion, though the cushioning, and into the folded portion.

6. The article of footwear of claim 5, wherein the cushioning is a nonwoven cushioning.

7. The article of footwear of claim 4, wherein the binding fibers are mechanically entangled without extending through the cushioning.

8. An article of footwear comprising:

an upper comprising a nonwoven textile and a seam joining a first edge and a second edge of the nonwoven textile;

the nonwoven textile further comprising a major portion, a folded portion, and an intermediate portion positioned between the major portion and the folded portion, wherein the major portion, the folded portion, and the intermediate portion are a continuous panel of the nonwoven textile, wherein a first folded edge joins the major portion to the folded portion and comprises an edge of an ankle collar, wherein a second folded edge joins the folded portion to the intermediate portion and positions the intermediate portion between the major portion and the folded portion, wherein the nonwoven textile comprises first fibers in the major portion, the folded portion, and the intermediate portion;

binding fibers that are each mechanically entangled with the first fibers of the major portion and the folded portion, wherein at least a portion of the binding fibers extend from the major portion, through the intermediate portion, and to the folded portion without extending through the first folded edge and the second folded edge.

9. The article of footwear of claim 8, wherein the seam is in a heel region of the article of footwear.

10. The article of footwear of claim 8, wherein:

the upper comprises a second nonwoven textile comprising a second major portion with second fibers and a second folded portion and second binding fibers mechanically entangled with the second fibers of the second major portion.

11. The article of footwear of claim 8, wherein the intermediate portion comprises a cushioning layer positioned between the folded portion and the major portion.

12. The article of footwear of claim 10 further comprising:

wherein the second folded portion comprises a second edge of the ankle collar of the article of footwear.

13. An article of footwear comprising:

a nonwoven textile comprising:

a major portion, a folded portion, and an intermediate portion positioned between the major portion and the folded portion, wherein the major portion, the folded portion, and the intermediate portion are a continuous panel of the nonwoven textile, wherein a first folded edge joins the major portion to the folded portion and comprises an edge of an ankle collar of the article of footwear, wherein a second folded edge joins the folded portion to the intermediate portion and positions the intermediate portion between the major portion and the folded portion, wherein the nonwoven textile comprises first fibers in the major portion, the folded portion, and the intermediate portion;

binding fibers mechanically entangled with the first fibers of the major portion and the folded portion, wherein at least a portion of the binding fibers extend from the major portion, through the intermediate portion, and to the folded portion without extending through the first folded edge and the second folded edge.

14. The article of footwear of claim 13, wherein the nonwoven textile comprises a terminal edge that is a rough edge positioned between the major portion and the folded portion, and wherein the first folded edge and the second folded edge are more uniform than the terminal edge of the nonwoven textile.

15. The article of footwear of claim 13, wherein the intermediate portion comprises a cushioning layer positioned between the folded portion and the major portion.

16. The article of footwear of claim 13, wherein cushioning is positioned between the intermediate portion and the folded portion.

17. The article of footwear of claim 16, wherein the binding fibers extend from the major portion, though the cushioning, and into the folded portion.

18. The article of footwear of claim 16, wherein the cushioning is a nonwoven cushioning.

19. The article of footwear of claim 16, wherein the binding fibers are mechanically entangled without extending through the cushioning.

20. The article of footwear of claim 13, wherein the first folded edge is attached to another portion of the article of footwear along a seam.

* * * * *